US006739963B1

(12) United States Patent
Mas García

(10) Patent No.: US 6,739,963 B1
(45) Date of Patent: May 25, 2004

(54) DISK FOR GRINDING CONCRETE

(75) Inventor: José Antonio Mas García, Alicante (ES)

(73) Assignee: Promociones Crevimas, S.L. (ES)

( * ) Notice: Subject to any disclaimer, the term of this patent is extended or adjusted under 35 U.S.C. 154(b) by 0 days.

(21) Appl. No.: 10/326,545

(22) Filed: Dec. 20, 2002

(51) Int. Cl.[7] ..... B24D 7/18

(52) U.S. Cl. ..... 451/541; 451/548; 451/549; 451/550; 451/353

(58) Field of Search ..... 451/69, 70, 353, 451/359, 527, 548, 461, 528, 549, 550, 551, 158, 259; 125/3, 28

(56) References Cited

U.S. PATENT DOCUMENTS

| | | | | |
|---|---|---|---|---|
| 1,932,319 A | * | 10/1933 | Myers | 451/353 |
| 2,727,699 A | * | 12/1955 | Bilane et al. | 242/472.7 |
| 5,403,231 A | * | 4/1995 | Duckworth | 451/344 |
| 5,567,503 A | * | 10/1996 | Sexton et al. | 428/143 |
| 5,762,545 A | | 6/1998 | Edwards | |

FOREIGN PATENT DOCUMENTS

| | | |
|---|---|---|
| DE | 587272 | 11/1933 |
| EP | 0 353 997 A2 | 2/1990 |
| EP | 1 247 617 A1 | 10/2002 |

* cited by examiner

*Primary Examiner*—George Nguyen
(74) *Attorney, Agent, or Firm*—Brinks Hofer Gilson & Lione

(57) ABSTRACT

Of the type designed to be attached to the propeller-shaped bases or heads of a concrete grinder, to enhance the grinding effect of said propeller-shaped bases after the latter are used without disks, it is shaped like a cross, with four equal arms which are equiangularly distributed, in the shape of an isosceles trapezoid, each of which has a curved-convex end (1), forming part of the imaginary circumferential outline corresponding to the theoretical disk, and curved-concave side edges (2–2'), which are joined to each other without a break in continuity between adjoining arms and which define a deep concave indentation (3), whose path is circumferential and whose radius appreciably coincides with the theoretical radius of the disk, so that a pair of disks may be used in a concrete grinder with two heads, working on the same plane without touching each other, by means of offsetting them angularly from each other by 45°.

1 Claim, 2 Drawing Sheets

DISK FOR GRINDING CONCRETE

DESCRIPTION OF THE INVENTION

This invention refers to a disk for grinding concrete, specially designed to be applied to a concrete grinder, and more specifically, to allow the use of this type of disks on grinders with two propeller-shaped bases.

The application of this invention is in the construction area, especially in obtaining concrete floors with a perfect surface finish.

BACKGROUND OF THE INVENTION

When preparing concrete pavement, the pouring of the raw material and its complementary vibrating are not sufficient to achieve a smooth enough surface, so when necessary, concrete grinders are used, based on a propeller-shaped base mechanism starting with rotating arms, generally four radial arms, so that the rotating action of these arms and their friction on the surface of the concrete grind this surface, to obtain the desired improved surface finish. In this sense, there are grinders with a single head and grinders with two, duly synchronized heads, whose arms cross each other, in other words, the distance between their rotational axes is substantially smaller than the sum of the radial dimension of two arms, to perform a joint function where the effect of one head partially overlaps the effect of the other. Obviously, to achieve this, the arms of one head must be angularly offset with respect to those of the other, which, in combination with their synchronized rotating motion, prevents these arms from interfering with each other.

A use of grinding disks is also known where, once the grinder has first been used with the disks, said disks are detached and the propeller-shaped bases alone are used, which helps give the concrete a better surface finish.

The grinding disks that are currently on the market are circular in shape, so that they can only be used on grinders with a single head, as on machines that have two heads these would interfere with each other since the disks have to work on the same plane, making normal operation of the machine impossible.

DESCRIPTION OF THE INVENTION

The disk that the invention proposes resolved the aforementioned problem in a fully satisfactory manner, so that, while performing satisfactorily as a grinding element, it can be used on grinders with either one or two heads.

More specifically, to achieve this, the disk that the invention proposes, starting with an imaginary circle, has four ample indentations, equiangularly distributed and curved-concave, which convert it into a type of "cross," with equal arms, in the shape of an isosceles trapezoid with slanting, curved-concave sides, so that the curvature and radius of these indentations roughly coincides with the radius of the disk itself, which, by means of proper angular offsetting between the two disks mounted on a grinder with two heads, prevents said disks from touching each other, as each arm of one of them fits into the respective indentation of the other, and vice-versa.

DESCRIPTION OF THE DRAWINGS

To complement this description and for the purpose of allowing for better understanding of the characteristics of the invention, in accordance with the example of its preferred embodiment, a set of drawings of an illustrative and non-restrictive nature, in which the following items are represented, is attached as an integral part of this description.

PREFERRED EMBODIMENT OF THE INVENTION

Figure 1:
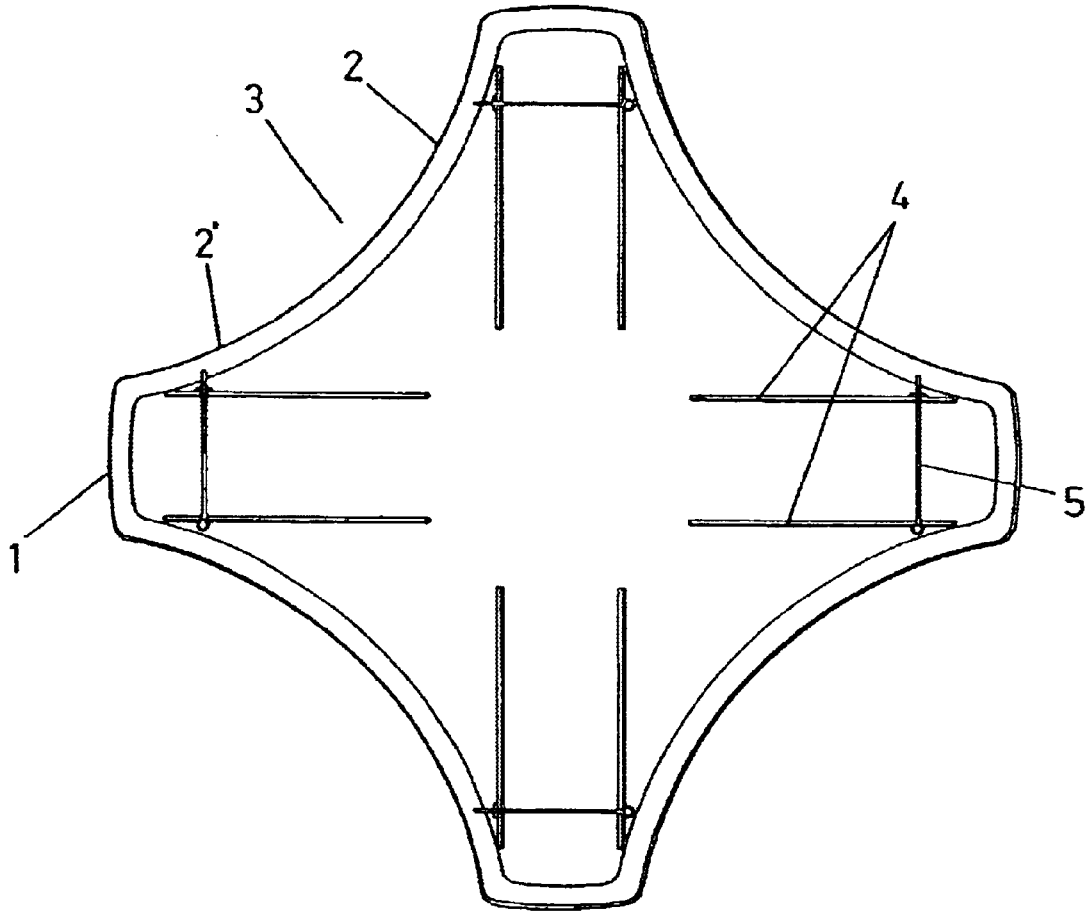
FIG. 1 shows an upper plan view of a disk for grinding concrete, produced in accordance with the object of the invention.
Figure 2:
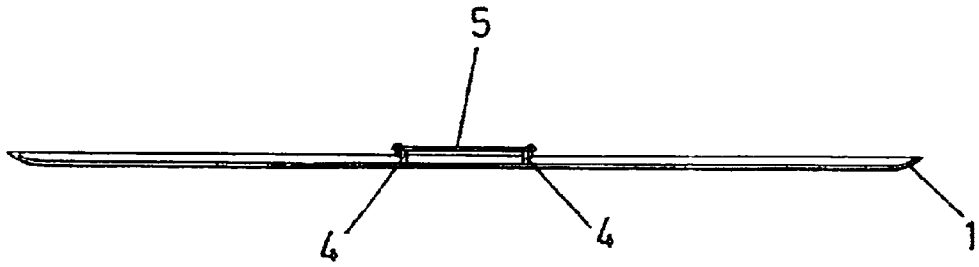
FIG. 2 shows the same disk in profile.
Figure 3:
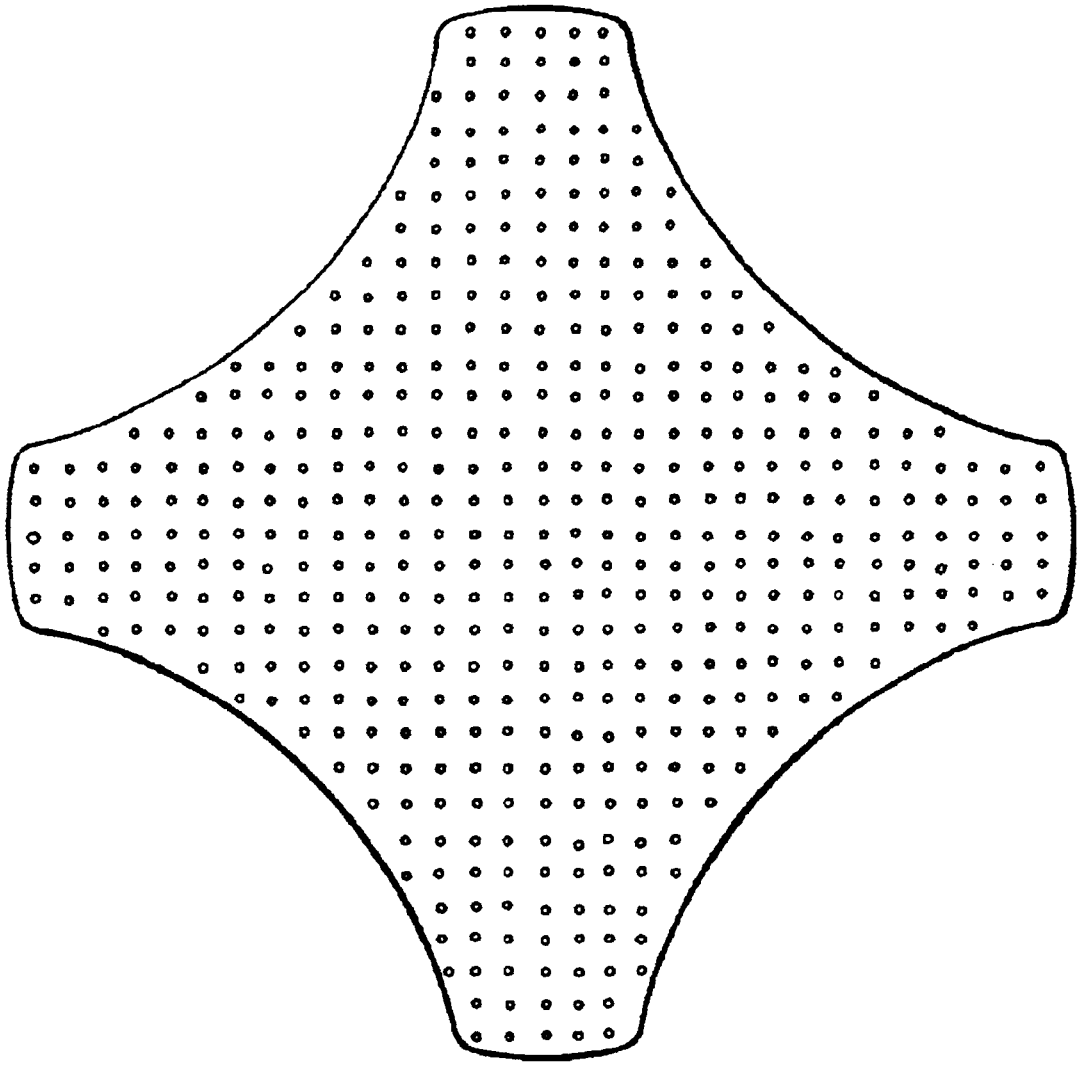
FIG. 3 shows a bottom plan view of the disk.

In light of the drawings briefly described, it can be seen that the disk proposed by the invention is shaped like a cross, so that the ends (1) of its arms, equiangularly distributed, form a curved-concave shape, thus forming part of an imaginary circumferential line, coinciding with the theoretical diameter of the disk and, consequently, with the diameter of the grinder's propeller-shaped base; these arms are in the shape of an isosceles trapezoid, and their side edges (2) are curved-concave and are joined with no break in continuity between adjoining arms, forming ample indentations in the form of a circumferential arc.

The radius of these indentations (3) appreciably coincides with the radius of the disk itself, the one generated by the curved ends (1) of its arms, so that in the case of a grinder with two heads, the arms on one of their disks are offset by 45° with respect to the arms on the other, the same as with the arms of the propeller-shaped bases themselves, so that in the area where the disks converge, each arm (1) corresponding to one of them fits into the indentation (3) of the other, and vice-versa.

This special disk shape not only allows it to be used on concrete grinders with two heads, but also, both in this type of grinders and in grinders with a single head, results in better performance, as no concrete "burrs" are formed on the outer part of the disk. In addition, they are able to lie flatter on the concrete, avoiding the tendency of the machine to sink in when used with circular disks.

As it is conventional in other respects, the disk will incorporate the typical pairs of ribs (4) on its upper face, aligned with each one of its arms, between which there are pins (5) to secure it to the grinder's propeller-shaped base, with the aid of corresponding hooks, which are not shown in the drawings.

What is claimed is:

1. Disk for grinding concrete for use on grinding propeller-shaped bases of a concrete grinder comprising:

a bottom of the disk, at least a portion of the bottom composed of material suitable for grinding concrete; and an outline of the disk roughly in the shape of a cross, in which four equal arms are defined, equiangularly distributed, whose ends form part of an imaginary circumferential line corresponding to the theoretical diameter of the disk, while their side edges are curved, concave, and side edges of adjoining arms are joined without a break in continuity, defining between them an ample concave indentation, whose path is a circumferential arc, and whose radius appreciably coincides with the theoretical radius of the disk, so that a pair of disks attached to a machine equipped with two heads or propeller shaped bases, with said disks angularly offset by 45° with respect to each other, in their arrangement on the same plan and in working position, wherein each arm of a disk fits into a curved-concave indentation of the other one, and vice-versa, without touching each other.

* * * * *